United States Patent [19]

Tone et al.

[11] Patent Number: 4,995,230

[45] Date of Patent: Feb. 26, 1991

[54] STEAM SETTING SYSTEM FOR SPINNING BOBBIN

[75] Inventors: Shoichi Tone, Kyoto; Masaharu Kiriake, Joyo, both of Japan

[73] Assignee: Murata Kikai Kabushiki Kaisha, Kyoto, Japan

[21] Appl. No.: 256,599

[22] Filed: Oct. 12, 1988

[30] Foreign Application Priority Data

Oct. 19, 1987 [JP] Japan ..... 62-264775
Feb. 19, 1988 [JP] Japan ..... 63-38436

[51] Int. Cl.[5] ..... D01H 13/32

[52] U.S. Cl. ..... 57/281; 57/309; 68/5 C; 68/210

[58] Field of Search ..... 57/281, 282, 308, 309, 57/351, 276; 28/285, 286; 242/35.5 A; 68/5 C, 210

[56] References Cited

U.S. PATENT DOCUMENTS

| | | | |
|---|---|---|---|
| 2,465,130 | 3/1949 | Story | 28/285 |
| 2,962,857 | 12/1960 | Wood et al. | 57/282 X |
| 3,286,320 | 11/1966 | Voronin et al. | 28/285 |
| 4,523,441 | 6/1985 | Braybrook et al. | 57/308 X |
| 4,595,152 | 6/1986 | Matsui et al. | 242/35.5 A |
| 4,613,091 | 9/1986 | Kiriake | 242/35.5 A |
| 4,660,368 | 4/1987 | Küpper | 57/281 |
| 4,674,940 | 6/1987 | Uchida et al. | 242/35.5 A X |
| 4,825,668 | 5/1989 | Villard et al. | 68/120 X |

FOREIGN PATENT DOCUMENTS

| | | | |
|---|---|---|---|
| 49788 | 9/1911 | Australia | 68/5 C |
| 2052440 | 5/1972 | Fed. Rep. of Germany | 68/5 C |

*Primary Examiner*—Joseph J. Hail, III
*Attorney, Agent, or Firm*—Spensley, Horn, Jubas & Lubitz

[57] ABSTRACT

A steam setting system for steam setting a plurality of bobbins reduced by a fine spinning frame in which a steam setting apparatus comprising at least a pair of independent steam setting mechanisms is provided on the way of a bobbin feeder line connecting a fine spinning frame with a winder.

1 Claim, 6 Drawing Sheets

STEAM SETTING SYSTEM FOR SPINNING BOBBIN

FIELD OF THE INVENTION AND RELATED ART STATEMENT

The present invention relates to a steam setting system for steam setting a plurality of bobbins produced by a fine spinning frame.

A spun yarn such as cotton and wool is spun by a spinning machine, particularly a ring spinning frame, and is then supplied to an automatic winder for conducting a winding step. In the winding step, the yarn is wound in the form of a cheese or cone package in accordance with a subsequent step.

The package yarn as obtained above has a residual torque due to twisting in the spinning step. Therefore, before supplying the yarn to a weaving machine or a knitting machine, the yarn is normally treated by heat or steam setting.

That is to say, a plurality of the packages are loaded on a truck, and the truck is transported into an independent steam setting chamber. After the packages are treated by steam in the steam setting chamber for a given period of time, they are taken out to a subsequent step.

Alternatively, a plurality of the bobbins supplied from the fine spinning frame are packaged in a bobbin box at randam or regularly. Then, the bobbin box is transported into the steam setting chamber in the same manner as the above.

In any case, the bobbins or the packages are once transported into the independent steam setting chamber. Accordingly, a large space is necessary to define the independent steam setting chamber, and a labor is also necessary to transport the bobbins or the packages into and out of the steam setting chamber. Further, the working becomes more complex in concert with enlargement of the packages.

In the case of transporting the bobbin box storing the bobbins at random, there is a possibility of the yarn layers contacting with each other during transportation. Further, it is necessary to provide a feeding device for regularly feeding the bobbins one by one. In the case of directly connecting the fine spinning frame to the winder, it is necessary to consider a matching relationship between a space and a time for steam setting and an installation space of the fine spinning frame and the winder and a yarn treating capacity thereof.

OBJECT AND SUMMARY OF THE INVENTION

An object of the present invention is to provide a steam setting system for spinning bobbins whereby steam setting of the bobbins may be efficiently carried out and ensuring smooth and regular transportation of the bobbins.

According to an embodiment of the present invention, there is provided a steam setting apparatus provided on the way of a bobbin feeder line connecting a fine spinning frame with a winder, said steam setting apparatus comprising at least a pair of independent steam setting mechanisms.

According to the another embodiment of the present invention, there is provided a bobbin conveying system for conveying bobbins doffed by a fine spinning frame to a winder, which system comprises a pallet for mounting the bobbins, said pallet having a size corresponding to that of a steam setting apparatus, wherein the bobbins mounted on the pallet are collectively transported from the fine spinning frame to the winder through the steam setting apparatus.

DETAILED DESCRIPTION OF THE PREFERRED EMBODIMENTS

Figure 1:
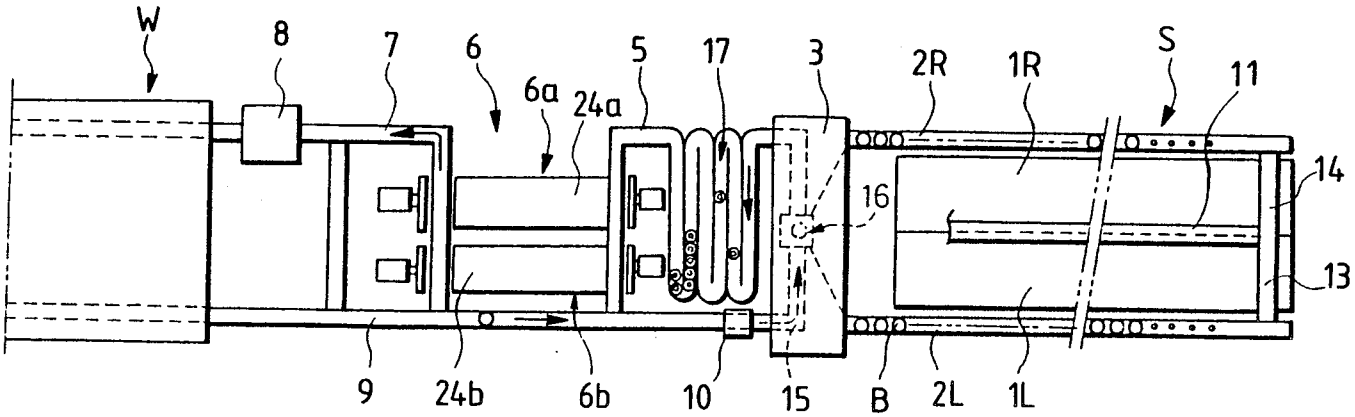
FIG. 1 is a plan view of the first preferred embodiment of the present invention.
Figure 2:
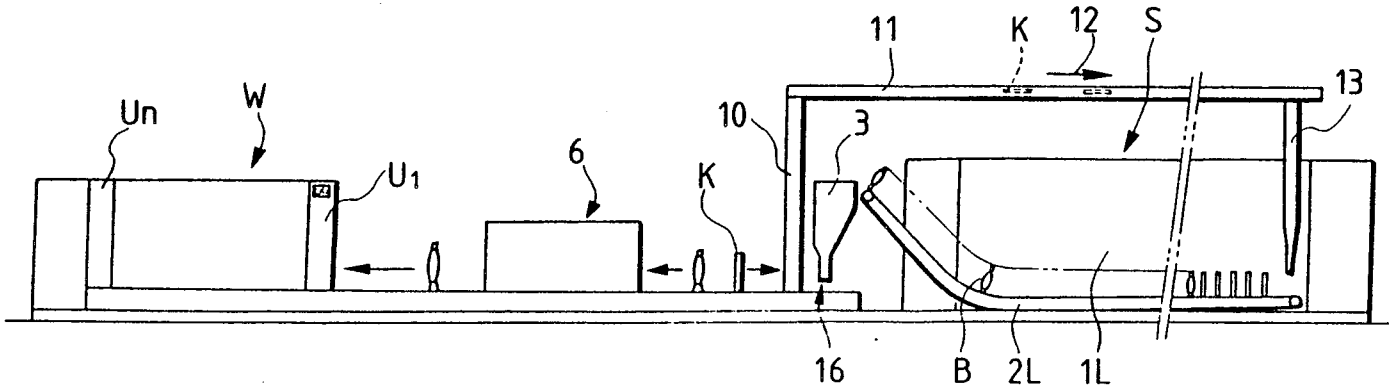
FIG. 2 is an elevational view of FIG. 1.

FIGS. 1 and 2 show an example of a so-called fine spinner/winder including a fine spinning frame S and a winder W directly connected with each other. The fine spinning frame S is constituted of a right component 1R and a left component 1L located back to back. Reference character B designates bobbins produced by the left component 1L, for example. The bobbins are doffed by a known auto-doffer and mounted to bobbin supporting pegs on a transport band 2L arranged along the left component 1L. The doffed bobbins B are transported to an end of the left component 1L by rotation of the transport band 2L, and they are shot into a chute 3 intermittently one by one from an upper end of an inclined portion of the transport band 2L. Then, each bobbin is ejected from the chute 3 to upright stand on a peg tray 4 (See FIG. 4) mounted on a bobbin transporting medium such as a belt conveyor located under the chute 3. The bobbins supported to the trays are transported through feeder lines 5 and 7 and a yarn end finding device 8 to the automatic winder W including a plurality of winding units Ul–Un.

After the yarn is wound by the automatic winder W, empty bobbins K or yarn remaining bobbins are ejected from the winder W, and are transported by a return conveyor 9 arranged along the winder W. The empty bobbins K are separated from the yarn remaining bobbins by a bobbin extractor 10, and are lifted by the bobbin extractor 10. Then, the empty bobbins K are transported in the direction of arrow 12 by a conveyor 11 arranged above the fine spinning frame and extending in the longitudinal direction thereof. The empty bobbins are distributed to right and left chutes 14 and 13 at the other end of the fine spinning frame. Then, the empty bobbins are ejected from the chutes 14 and 13, and are brought into fit with the pegs on the transport bands 2R and 2L.

On the other hand, the empty trays at the bobbin extractor 10 are further transported by a conveyor 15 to a new bobbin supply position 16 where new bobbins are supplied from the fine spinning frame as mentioned above.

There will now be described a steam setting apparatus to be applied to the fine spinner/winder as mentioned above. Reference numeral 6 designates the steam setting apparatus of a preferred embodiment of the present invention. The steam setting apparatus 6 is located between the feeder lines 5 and 7. A part of the feeder line 5 constitutes a reserve line 17 for reserving the bobbins ejected from the fine spinning frame S.

The steam setting apparatus 6 comprises at least a pair of independent steam setting mechanisms 6*a* and 6*b*. The steam setting mechanisms 6*a* and 6*b* have steam boxes 24*a* and 24*b* for storing the bobbins, respectively, which steam boxes 24*a* and 24*b* are fixed on a floor. The bobbins with the trays transported by the conveyor 5 are allowed to enter either of the steam box 24*a* or 24*b*. That is, when the steam box 24*b* is operated, for example, the bobbins are allowed to enter the steam box 24*a*.

Figure 3:
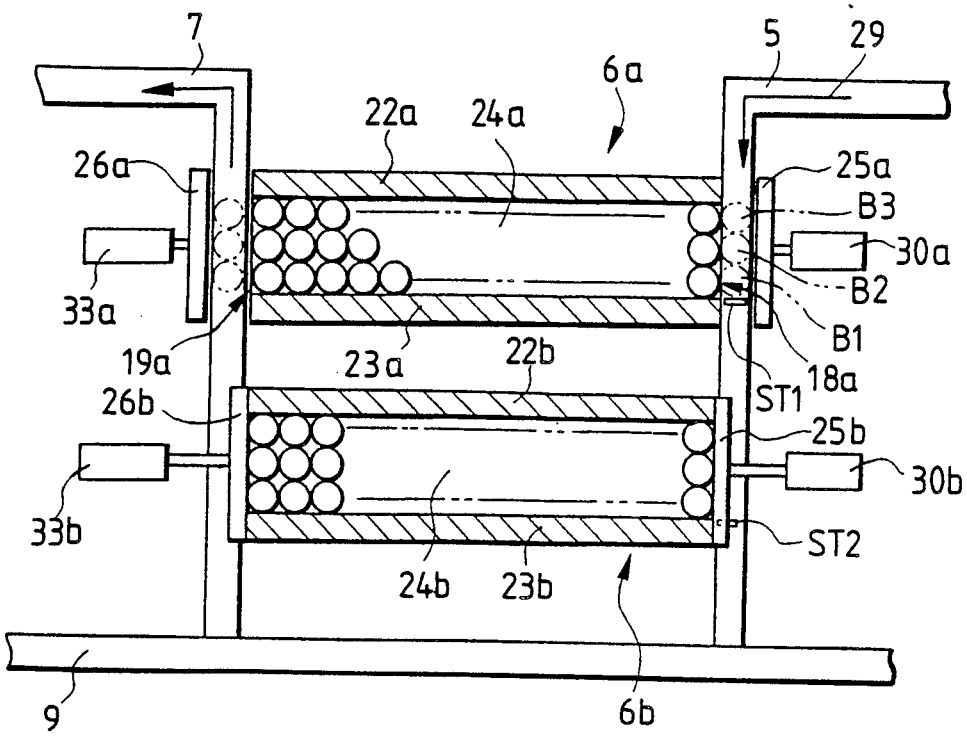
FIG. 3 is a partially sectional plan view of the steam setting apparatus shown in FIG. 1.
Figure 4:
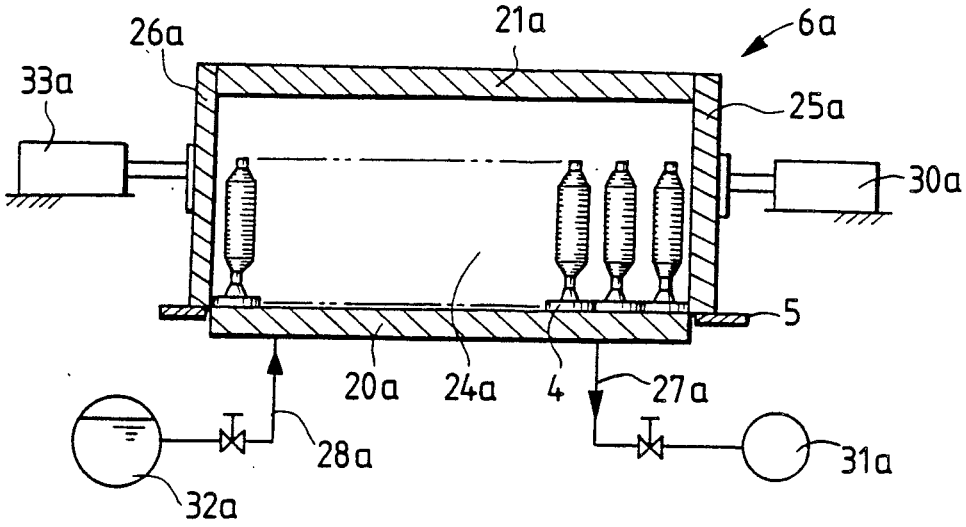
FIG. 4 is an elevational view of FIG. 3.

As the steam setting mechanisms 6*a* and 6*b* have the same construction, the following description will be referred to the steam setting mechanism 6*a* only, for example. Referring to FIGS. 3 and 4 which show the detailed construction of the steam setting mechanism 6*a*, the bobbin box 24*a* forming the steam setting mechanism is of a tunnel-like configuration having a bobbin inlet 18*a*, a bobbin outlet 19*a* at opposite ends, a bottom surface 20*a*, a top surface 21*a* and opposite side surfaces 22*a* and 23*a*. The bobbin inlet 18*a* and the bobbin outlet 19*a* and adapted to be opened and closed by movable doors 25*a* and 26*a*, respectively. The bottom surface 20*a* serves as a bobbin feeder line, and it is formed with openings at suitable positions to be connected to a vacuum pipe 27*a* for making vacuum in the box and a steam pipe 28*a* for supplying steam into the box. The openings of the pipes 27*a* and 28*a* may be formed on the top surface 21*a* of the box 24*a*.

As shown in FIG. 3, when a given number of bobbins B1, B2 and B3 are supplied along the arrow 29 on the feeder line 5, and are stopped by a movable stopper ST1 located at a fixed position of the inlet 18*a* of the box 24*a*, an array of the bobbins B1–B3 with the trays is pushed into the box 24*a* by the movable door 25*a* to be driven by a cylinder 30*a* or the like. Such an operation is repeated to store a given number of the bobbins in the box 24*a*. Then, the movable door 25*a* at the inlet 18*a* and the movable door 26*a* at the outlet 19*a* are closed as shown in FIG. 4 to make an enclosed condition of the box 24*a*. Under the enclosed condition, the box 24*a* is evacuated by a suction pump 31*a*, and steam is injected into the box 24*a* from a hot water tank 32*a*, thus carrying out steam setting of the spinner bobbins.

When a set time as set according to a winding speed of the winder and a producing speed of the fine spinning frame is elapsed, the movable door 26*a* at the outlet 19*a* is opened by a cylinder 33*a*, and the movable door 25*a* is also opened by the cylinder 30*a*. Then, subsequent unset bobbins are pushed into the box 24*a* in the same manner as the above to thereby eject the set bobbins from the outlet 19*a* of the box 24 onto the conveyor 7. Thus, the reciprocative operation of the movable doors 25 at the inlet 18*a* is repeated a given times to replace the set bobbins in the box 24*a* by the unset bobbins.

Alternatively, the movable door 25*a* may be dedicatedly used as a pusher, and a vertically slidable door for opening and closing the inlet 18*a* of the box 24*a* may be provided so as to closely enclosing the box 24*a*.

Furthermore, it is preferred to provide a reserve line for reserving the empty bobbins between the winder W and the empty bobbin extractor 10, so as to balance a steam setting time in the above system wherein the fine spinning frame is directly connected to the winder.

In the preferred embodiment mentioned above, the steam setting time is controlled in such a manner that while the box 24*b* is operated, the set bobbins are ejected from the other box 24*a*, and conversely while the box 24*a* is operated, the set bobbins are ejected from the other box 24*b*, so that the set bobbins may be smoothly supplied to the winder without a waiting time of the winder. In this case, the reserve line 17 shown in FIG. 1 may be omitted.

The distribution of the unset bobbins to the boxes 24*a* and 24*b* is easily effected by the movable stoppers ST1 and ST2 adapted to be projected and retracted from the conveyor 5 and abutting against the tray or the bobbin. That is, when the stopper ST1 is in an operative position, namely, it is projected from the conveyor 5, the leading bobbin conveyed along the arrow 29 abuts against the stopper ST1 to be stopped. On the contrary, when the stopper ST1 is in a retracted position, and the stopper ST2 is in a projected position, the leading bobbin is stopped by the stopper ST2 at the inlet of the box 24*b*.

When both the stoppers ST1 and ST2 are in the retracted position, the unset bobbins are transported from the conveyor 5 to the return conveyor 9, and they are returned by the return conveyor 9 to the reserve line 17.

The suction pump 31*a* and the hot water tank 32*a* shown in FIG. 4 may be provided for each of the setting mechanisms 6*a* and 6*b*, or they may be provided commonly for the setting mechanisms 6*a* and 6*b*. In this case, the selection of the setting mechanisms 6*a* and 6*b* may be simply effected by providing a selector valve in a piping.

In the above system, the transport bands 2R and 2L of the fine spinning frame S can be rotated regardless of a steam setting time. That is, in the case that the reserve line 17 has a space capable of storing all the bobbins to be ejected from the fine spinning frame S, all the bobbins can be continuously ejected from the fine spinning frame S. Accordingly, although the empty bobbins are returned to the end of the fine spinning frame opposite to the ejecting end thereof in the above preferred embodiment, a conventional fine spinning frame receiving the empty bobbins at the same end as the ejecting end may be connected to the winder.

The winder to be applied to the above system may be of various types. For example, a winder disclosed in Japanese Patent Laid-Open Publication No. 58-157678 (U.S. Pat. No. 4,613,091) may be used.

Figure 5:
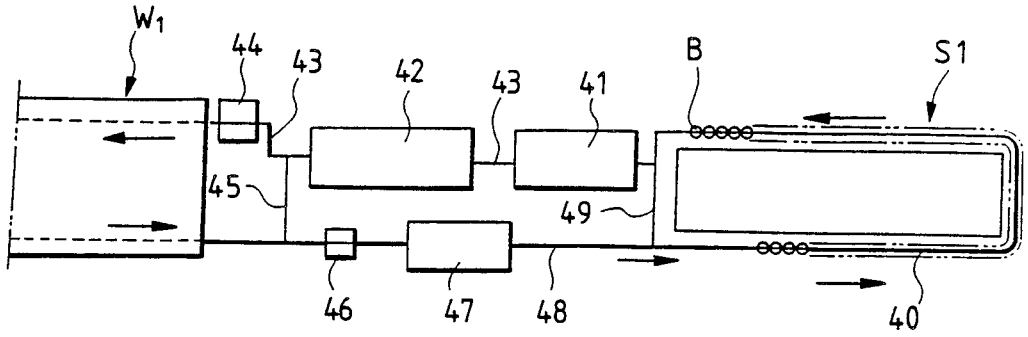
FIG. 5 is a plan view of the second preferred embodiment of the present invention.

FIG. 5 shows another preferred embodiment of the bobbin treating system according to the present invention. In the preferred embodiment shown in FIG. 5, a bobbin feeder line 40 is so arranged as to surround a fine spinning frame S1, and it is directly connected to a bobbin feeder line on a winder W1 side. In this construction, the trays for transporting the bobbins are circulated between the winder the fine spinning frame.

A plurality of spinning bobbins B ejected from the fine spinning frame S1 are transported through a reserve section 41 provided on the way of a feeder line 43 to a steam setting apparatus 42 in the same manner as the previous preferred embodiment, and are treated with steam by the steam setting apparatus 42. The treated bobbins ejected from the steam setting apparatus 42 are supplied through a yarn end finding device 44 to the winder W1. After the yarn is wound by the winder W1, the empty bobbins and the yarn remaining bobbins are ejected from the winder W1. The yarn remaining bobbins are supplied through a bypass 45 to the yarn end finding device 44, and any other bobbins attaching very small yarn which cannot be reused are supplied to a residual yarn removing device 46 whereby the very small yarn is removed. The empty bobbins ejected from the residual yarn removing device 46 are transported through an empty bobbin reserve section 47 on a feeder line 48 to the fine spinning frame S1. Reference numeral 49 designates a bypass for returning any empty bobbins created at the end of the fine spinning frame S1 to the fine spinning frame S1 again.

As mentioned above, the spinning bobbins produced by the fine spinning frame are treated by the steam setting apparatus located on the way of the feeder line connected to the winder. That is, it is unnecessary to feed the spinning bobbins to the independent steam setting chamber.

As described above, the present invention provides a steam setting apparatus for steam setting the bobbins produced by the fine spinning frame, on the way of a feeder line connected to the winder. Accordingly, the problems in the conventional process are solved, and steam setting of the bobbins may be efficiently carried out.

There will be described some preferred embodiments of the present invention in which bobbins are mounted on a pallet having a size corresponding to that of a steam setting apparatus and are collectively transported from a fine spinning frame to a winder.

Figure 6:
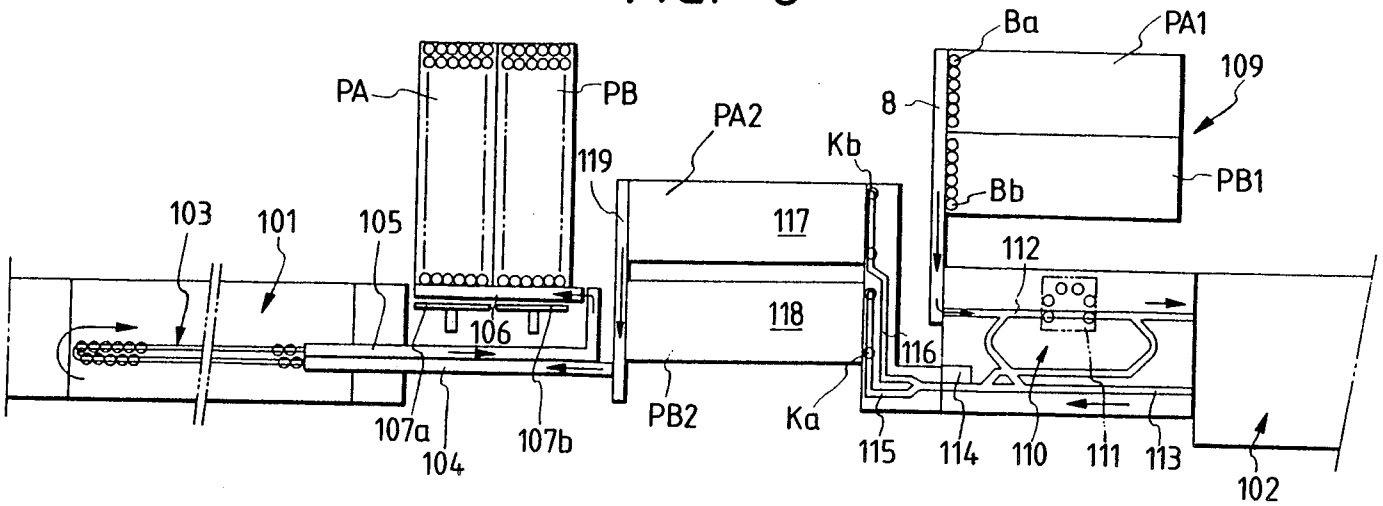
FIG. 6 is a plan view of the third preferred embodiment of the present invention having a transporting system.
Figure 7:
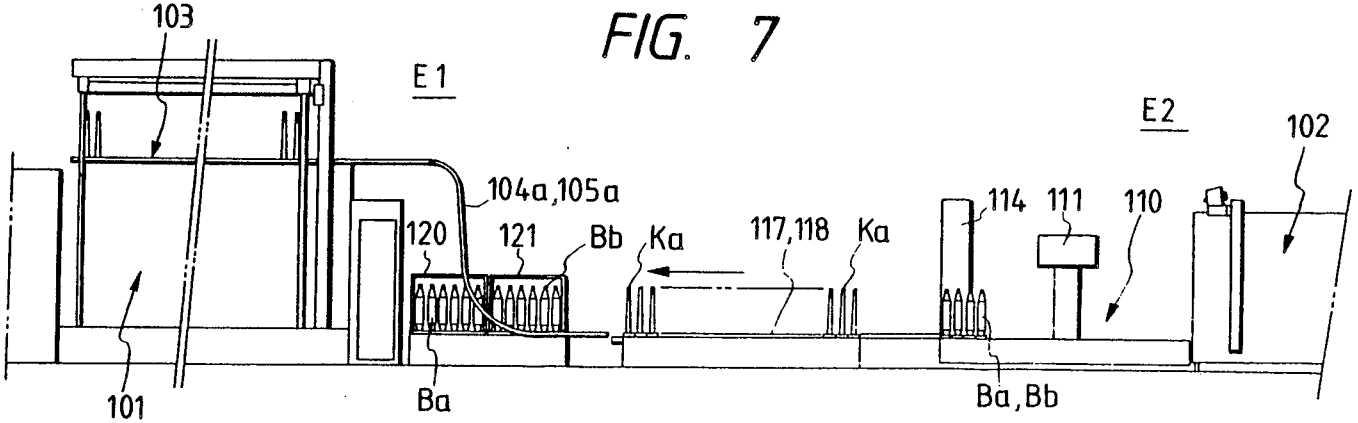
FIG. 7 is an elevational view of FIG. 1.

FIGS. 6 and 7 show a third preferred embodiment of the present invention, wherein a plurality of bobbins are supported to independent bobbin trays constituting a bobbin transporting medium and are circulated between a fine spinning frame 101 and a winder 102.

As shown in FIGS. 6 and 7, the fine spinning frame 101 and the winder 102 are arranged adjacent to each other. The bobbins doffed in the fine spinning frame 101 are fed to pallets PA and PB and arranged regularly thereon. Then, the pallets PA and PB are transported. On the other hand, empty bobbins ejected from the winder 102 are returned through pallets PA2 and PB2 as a transporting line to the fine spinning frame 101.

A bobbin feeder line 103 is provided above a base of the fine spinning frame 101, and is connected through inclined feeder lines 104*a* and 105*a* to bobbin feeder lines 104 and 105 provided on a floor at an end portion of the base. The inclined feeder lines 104*a* and 105*a* are adapted to carry the trays by nipping same with a belt and a pressure guide, for example.

The bobbin feeder lines 104 and 105 constitute an empty bobbin conveyor and a spinning bobbin conveyor, respectively. The spinning bobbin conveyor 105 is connected to a spinning bobbin loading station 106 including the bobbin loading pallets PA and PB and tray pushers 107*a* and 107*b*.

On the other hand, the winder 102 is connected to a spinning bobbin supplying station 109 for ejecting the spinning bobbins mounted on pallets PA1 and PB1 to a conveyor 108. The spinning bobbin supplying station 109 includes a bobbin pushing means (not shown) such as a pusher to be driven by a cylinder or a bobbin feeding means (not shown) such as a bobbin chucker for feeding the spinning bobbins Ba and Bb on the pallets PA1 and PB1 one by one to the conveyor 108. The conveyor 108 is connected to a readying area 10 located on one side of the winder 102. The readying area 110 includes a yarn end finding device 111 for receiving the spinning bobbins with the trays transported by the conveyor 8. In the readying area 110, yarn of the spinning bobbins is treated, and the various bobbins ejected from the winder are treated. In the preferred embodiment shown in FIGS. 6 and 7, the yarn end finding device 111 is provided on the way of a feeder line 112 to be connected to each winding unit of the winder 102, and there is provided on the way of a feeder line 113 for feeding the bobbins ejected from the winder 102 means 114 for selecting a yarn remaining bobbin and a very small yarn remaining bobbin or removing very small yarn from the bobbins. Accordingly, the empty bobbins with the trays only are ejected from the means 114 and transported by branch lines 115 and 116.

The pallets PA2 and PB2 constitute empty bobbin feeder lines 117 and 118 provided between a winder area E2 and a fine spinning frame area E1. That is, the pallets PA2 and PB2 are connected at their one end to the branch lines 116 and 115, respectively, and are connected at the other end to a conveyor 119 in the fine spinning frame area E1.

The winder area E2 may include a pusher for pushing the empty bobbins Ka and Kb with the trays arranged on the branch lines 115 and 116 onto the pallets PB2 and PA2. In this case, the empty bobbins are allowed to be sequentially fed from the other end of the pallets PA2 and PB2 to the conveyor 119.

On the other hand, when a given number of the spinning bobbins are loaded on the pallets PA and PB in the spinning bobbin loading station 106, the spinning bobbins are treated by steam in this position. Alternatively, after the pallets PA and PB mounting the spinning bobbins thereon are transported to an independent steam setting tank, the spinning bobbins are treated by steam. As shown in FIG. 7, the pallets PA and PB constitute steam setting chambers defined by walls 120 and 121.

After the spinning bobbins on the pallets PA and PB are treated by steam, the pallets PA and PB are transported to the spinning bobbin supplying station 109 in the winder area E2 by mans of an unmanned truck or a roller conveyor.

Figure 8:
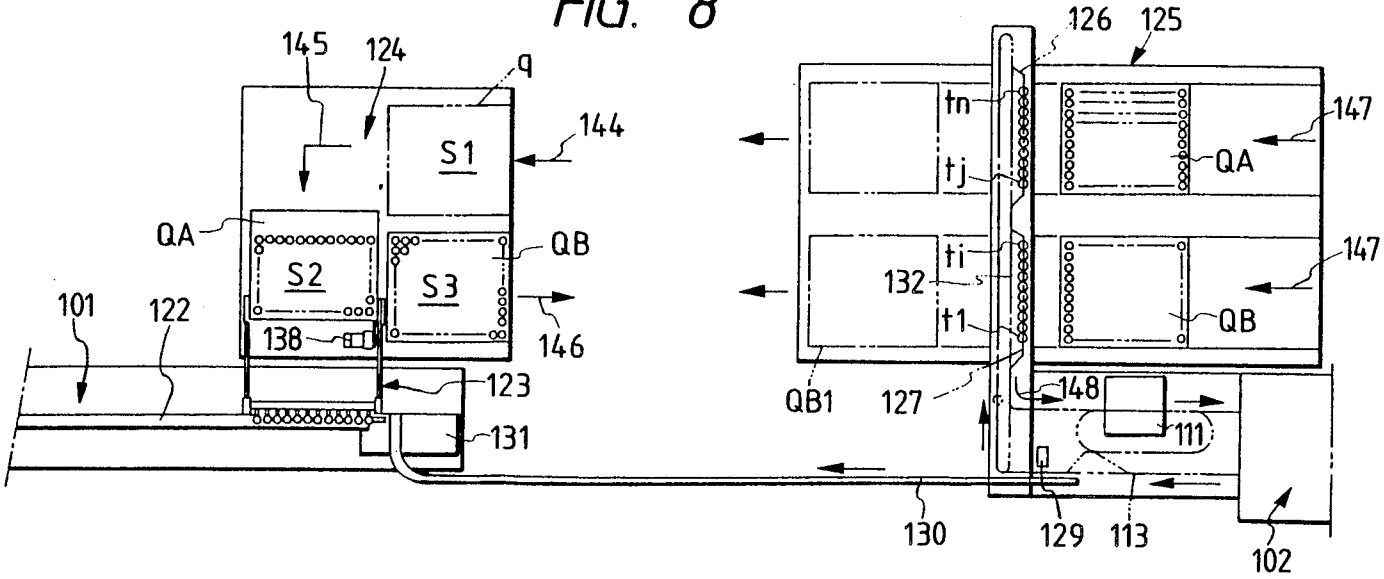
FIG. 8 is a plan view of the fourth preferred embodiment of the present invention.
Figure 9:
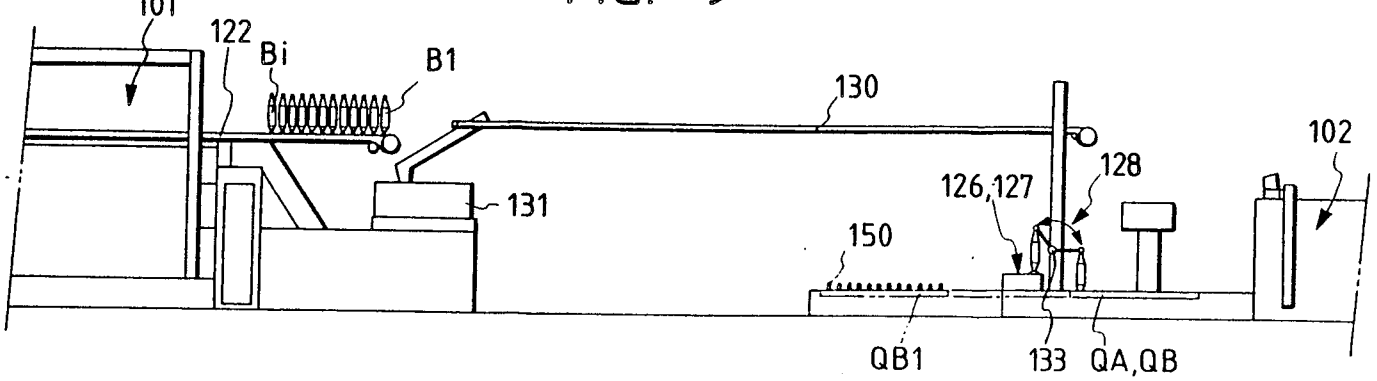
FIG. 9 is an elevational view of FIG. 8.
Figure 10:
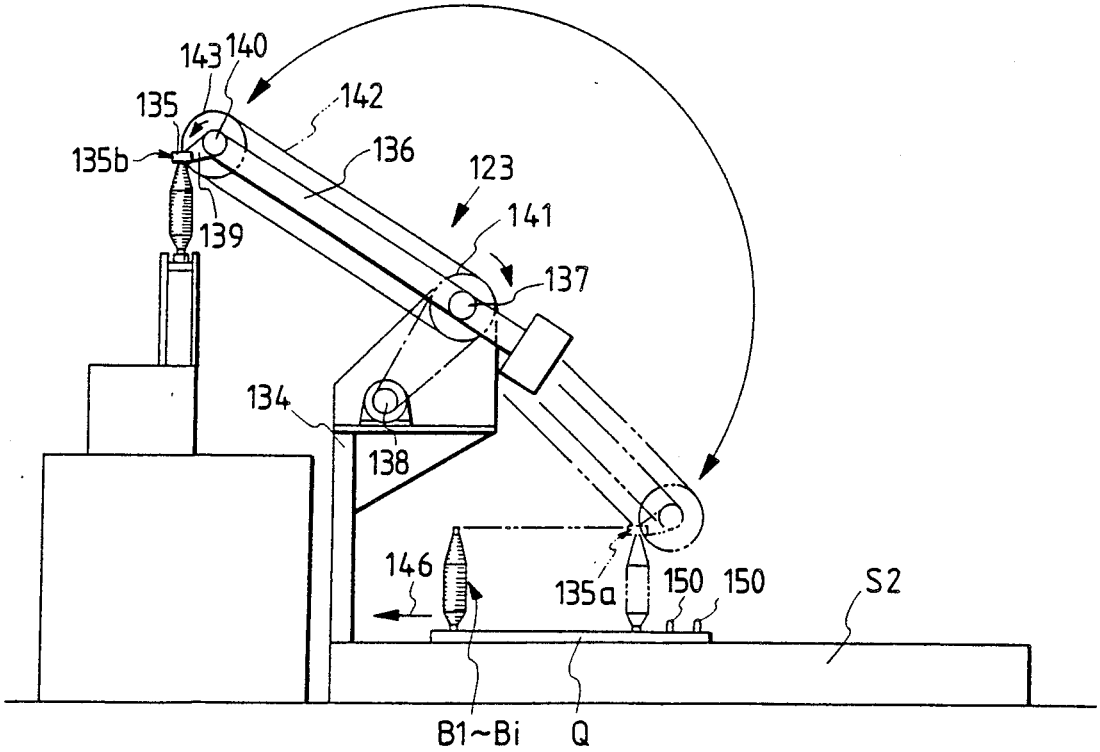
FIG. 10 is a side view of the bobbin loading device shown in FIG. 8.

FIGS. 8 to 10 show a fourth preferred embodiment of the present invention. In the fourth preferred embodiment, the trays for supporting the bobbins are circulated in the winder area only, and pallets QA and QB have a plurality of bobbin supporting pegs 150 fixed thereto and arranged regularly. The fine spinning frame 101 and the winder 102 are arranged adjacent to each other or in spaced relationship to each other.

A transport band 122 is provided above the base of the fine spinning frame 101 so as to transport a plurality of spinning bobbins Bl–Bi. The spinning bobbins Bl–Bi are loaded by a spinning bobbin loading device 123 to the pallet QA positioned in a station 124. The station 124 has an empty pallet (q) receiving position S1, a spinning bobbin loading position S2 and a spinning pallet ejecting position S3. The pallet QB mounting the spinning bobbins is ejected from the position S3, and is transported to a steam setting apparatus.

After the spinning bobbins are treated by the steam setting apparatus, the pallets QA and QB mounting the set bobbins are transported to a spinning bobbin supplying station 125. Then, the spinning bobbins on the pallets QA and QB are unloaded by a bobbin unloading device 128 to empty trays arranged on conveyors 126 and 127, respectively.

The empty bobbins with the trays ejected from each winding unit of the winder 102 are separated from the trays by an empty bobbin separating device 129 provided on the way of the feeder line 113. The empty bobbins are transported by a conveyor 130 to an empty bobbin stocker 131 provided on the side of the fine spinning frame 101, while the empty trays are transported by a conveyor 132 to the branch lines 126 and 127. The bobbin unloading device 128 has a plurality of bobbin chucks 135 corresponding to one array of the spinning bobbins on the pallet QA for example, so that the bobbin chucks 135 may be moved about a shaft 133 between two positions.

Referring to FIG. 10 which shows an example of the bobbin loading device 123 provided on the side of the fine spinning frame 101, a frame 134 is provided between the base of the fine spinning frame 101 and the pallet QA at the bobbin loading position S2. A support shaft 137 for supporting a turning arm 136 is rotatably mounted to the frame 134. The turning arm 136 having a bobbin chuck 135 at one end thereof is adapted to be reversibly rotated by a motor 138 mounted on the frame 134, so that the bobbin chuck 135 may be moved between a bobbin chucking position **135*b* and a bobbin releasing position 135*a*. The bobbin chuck 135 at one end of the turning arm 136 is supported by a bracket 139 rotatably mounted on a shaft 140, so that the bobbin chuck 135 may be moved substantially vertically at the bobbin chucking position 135*b* and the bobbin releasing position 135*a*, and they may be moved in parallel during turning of the turning arm 136. That is, while the turning arm is being rotated clockwise about the shaft 137, the bracket 139 is rotated counterclockwise about the shaft 140 to effect parallel movement of the spinning bobbin by means of mechanical elements such as gears 141 and 143 and a chain 142**. The bobbin loading device may be constructed by a polar coordinates robot or a similar bobbin chuck capable of vertically moving and rotating.

The operation of the fourth preferred embodiment will now be described.

The empty pallet transported from the winder area by a truck or the like is loaded on the station S1 in the direction of arrow 144. Then, the empty pallet q is moved by a moving means such as a conveyor to the bobbin loading position S2 in the direction of arrow 145. On the other hand, the spinning bobbins Bl–Bi arranged on the transport band 122 are collectively loaded by the bobbin loading device 123 to the pegs in one array on the pallet QA. Such a loading operation is repeated for every array of the pegs as pitch feeding of the pallet QA to thereby load the spinning bobbins to all the pegs. Then, the pallet QA is moved to the station S3, and is transported to the steam setting apparatus in the direction of arrow 146.

The spinning bobbins on the pallet treated by the steam setting apparatus are loaded onto the bobbin supplying station 125 in the winder area in the direction of arrow 147. Then, the spinning bobbins on the pallets QA and QB are unloaded to the empty trays tl–ti and tj–tn on the conveyors 26 and 27 by the bobbin unloading device 128. For example, every time the bobbins Bl–Bi of one array on the pallet QB are collectively unloaded to the empty trays tl–ti, the pallet QB is moved by one pitch in the direction of arrow 47. Thus, all the spinning bobbins on the pallet are unloaded, and the empty pallets QA1 and QB1 are returned to the fine spinning frame area by a truck or the like. As shown in FIG. 9, there is defined under the conveyor 132 a space for allowing pass of the pallets QA and QB to be fed per pitch by a conveyor or the like.

The trays mounting the spinning bobbins thereon are conveyed in the direction of arrow 148, and are supplied via yarn end finding device 111 to each winding unit of the winder 102. The empty bobbins with the trays ejected from the winder are separated from the trays by the empty bobbin separating device 129, and are conveyed by a ceiling conveyor line 130 to the fine spinning frame 101.

In the above preferred embodiments, the bobbins may be of one kind or plural kinds. For example, when the bobbins of a kind A are loaded on the pallet PA and the bobbins of a kind B are loaded on the pallet PB in the first preferred embodiment, different bobbin identification marks are provided on the trays to make possible that specified bobbins are supplied to specified winding units of the winder.

Similarly in the fourth preferred embodiment, the bobbins of a kind A may be loaded on the pallet QA and the bobbins of a kind B may be loaded on the pallet QB.

In the third preferred embodiment wherein the assembly of the bobbin and the tray is transported between the fine spinning frame and the winder, the loading/unloading of the trays between the conveyor and the pallet may be carried out by a pusher device for pushing the trays. In the fourth preferred embodiment wherein the bobbin is separated from the tray, the loading/unloading of the bobbins between the conveyor and the pallet may be carried out by a bobbin chuck device for chucking and moving the bobbins.

As described above, the bobbins are mounted on a pallet having a size corresponding to that of a steam setting apparatus, and the pallet is transported between the fine spinning frame and the winder. Accordingly, loading/unloading, steam setting and transporting of the bobbins may be carried out simply. Further, the pallet itself also serves as a bobbin stocker for reserving the bobbins ejected from the fine spinning frame. As compared with a conventional system wherein the bobbins are stored at random in a bobbin box, and they are transported one by one, the present invention is superior since the pallet mounting the bobbins thereon is transported to the preparing station of the winder area, thereby preventing the yarn layers of the bobbins from contacting with each other and ensuring smooth and regular transportation of the bobbins.

What is claimed is:

1. In a bobbin transferring system for transferring bobbins along a path, the improvement comprising:

a steam setting device arranged along the bobbin path, the steam setting device comprises a housing having an interior suitable for accommodating a plurality of bobbins, simultaneously, a bobbin inlet and a bobbin outlet;

a first bobbin conveyor extending toward the bobbin inlet, and a second bobbin conveyor extending from the bobbin outlet;

a bobbin reservoir arranged along the first bobbin conveyor;

wherein the bobbins transferred along the path are conveyed by the first conveyor to the bobbin inlet and by the second conveyor from the bobbin outlet;

stopping means for stopping bobbins conveyed by the first conveyor adjacent the bobbin inlet of the steam setting device; and bobbin transferring means for transferring bobbins stopped by the stopping means into the housing of the steam setting device through the bobbin inlet;

wherein the bobbin transferring means comprises a movable door movable adjacent the bobbin inlet between an open position, at which the bobbin inlet is open, and a closed position, at which the bobbin inlet is traversed by the door, wherein the movable door comprises a surface which is arranged to contact and push bobbins stopped by the stopping means through the bobbin inlet upon the movable door being moved to the closed position.

* * * * *